US008176974B2

(12) United States Patent
Stier

(10) Patent No.: US 8,176,974 B2
(45) Date of Patent: May 15, 2012

(54) HEAT TRANSFER UNIT FOR HIGH REYNOLDS NUMBER FLOW

(75) Inventor: Randy S. Stier, San Antonio, TX (US)

(73) Assignee: UOP LLC, Des Plaines, IL (US)

( * ) Notice: Subject to any disclaimer, the term of this patent is extended or adjusted under 35 U.S.C. 154(b) by 40 days.

(21) Appl. No.: 12/905,552

(22) Filed: Oct. 15, 2010

(65) Prior Publication Data

US 2011/0030937 A1 Feb. 10, 2011

Related U.S. Application Data

(63) Continuation of application No. 12/033,989, filed on Feb. 20, 2008, now Pat. No. 7,954,544.

(60) Provisional application No. 60/990,902, filed on Nov. 28, 2007.

(51) Int. Cl.
*F28F 1/14* (2006.01)
*F28F 13/12* (2006.01)

(52) U.S. Cl. ..... 165/183; 165/109.1

(58) Field of Classification Search ..... 165/183, 165/109.1, 177, 178, 133; 138/38; 126/99 A; 422/196, 200, 205, 312
See application file for complete search history.

(56) References Cited

U.S. PATENT DOCUMENTS

| | | | | |
|---|---|---|---|---|
| 4,342,642 | A * | 8/1982 | Bauer et al. | 208/130 |
| 4,827,074 | A * | 5/1989 | Suwa et al. | 585/648 |
| 4,997,525 | A * | 3/1991 | Martens et al. | 196/110 |
| 5,271,809 | A * | 12/1993 | Holzhausen | 196/110 |
| 5,409,675 | A * | 4/1995 | Narayanan | 422/659 |
| 6,419,885 | B1 * | 7/2002 | Di Nicolantonio et al. | 422/198 |
| 6,644,358 | B2 * | 11/2003 | Demarest et al. | 138/177 |
| 7,135,105 | B2 * | 11/2006 | Zeng et al. | 208/106 |
| 7,954,544 | B2 * | 6/2011 | Stier | 165/183 |
| 2008/0149309 | A1 * | 6/2008 | Li et al. | 165/104.19 |

* cited by examiner

*Primary Examiner* — Tho V. Duong
(74) *Attorney, Agent, or Firm* — Mark R Willis

(57) ABSTRACT

In one aspect, a heat transfer unit is provided for increasing the temperature of process fluids, such as gas-phase fluids, having a Reynolds Number (RE) of at least about 275,000 with a low overall pressure drop and without exceeding the wall temperature limits of the material used to construct the heater. The heater generally includes a heater conduit having the gas-phase fluid flowing therethrough and a heat source, such as a radiant heat source, providing an inconsistent or variable heat flux along a length of the heater conduit where the heat source has a peak heat flux greater than an average heat flux.

16 Claims, 7 Drawing Sheets

HEAT TRANSFER UNIT FOR HIGH REYNOLDS NUMBER FLOW

CROSS-REFERENCE TO RELATED APPLICATIONS

This application is a Continuation of copending application Ser. No. 12/033,989 filed Feb. 20, 2008, which in turn claims priority from Provisional Application No. 60/990,902 filed Nov. 28, 2007, both of which are hereby incorporated herein by reference in their entirety.

FIELD

The field relates to heat transfer of fluids and, more particularly, to heat transfer of gas-phase fluids at high Reynolds Numbers.

BACKGROUND

In the oil refining and petrochemical industries, heat transfer units are commonly used to raise the temperature of a gas, liquid, or other multi-phase fluid to higher temperatures as required for a variety of downstream processing operations. Depending on the process and the heat transfer needs, the heat transfer unit can be a heat exchanger, boiler, fired heater, or other accepted heat transfer systems. In such systems, it is common for an input fluid of a lower temperature to be heated to a higher temperature by passing the fluid through a tube, between plates, or through other conduits where an external heat source applies a heat flux (which often is expressed as the rate of heat transfer per unit area) across the conduit in order to raise the temperature of the fluid flowing therein. In such systems, the heat transfer occurs through conductive heating, convective heating, radiant heating, or a combination of conductive, convective, and radiant heating, as well as other heat transfer mechanisms. Convective heat transfer generally involves a thermal energy exchange between a surface and a moving fluid. Conductive heat transfer typically involves the transfer of thermal energy through a solid or liquid from a region of high temperature to a region of low temperature. Radiant heat transfer is the transfer of thermal energy by radiation from a surface or other source.

In conventional heat exchangers or boilers, for example, the heating medium is provided at a relatively consistent flow along the length of conduit in the heat exchanger so that a relatively consistent heat transfer is obtained along the entire length of conduit. Such systems typically provide a relatively consistent heat flux along the length of the conduit, and fluctuations in the heat flux are preferably minimized. In other cases, such as in a fired heater for example, the tubing or conduit of the furnace extends through a heater box containing one or more burners therein to provide a radiant heat source to increase the temperature of the fluid flowing through the tubing. In these radiant heating systems, the radiant heat flux can vary substantially along the length of heater tubing so that a relatively inconsistent heat transfer occurs along the length of tubing. A peak radiant heat flux generally occurs along the tubing closest to the radiant heat source and the heat flux decreases the farther the tubing is from the heat source.

Often a fired heater is required to heat the gas, liquid, or other multi-phase fluid to temperatures of about 537° C. (1000° F.) or greater, which requires a relatively high heat flux to be applied to the heater coil. In such instances, due to the high heat flux, particularly at those portions closest the heat source, the coils are commonly fabricated from materials capable of withstanding high temperatures, which are often exotic metal alloys such as chromium-molybdenum steels and certain stainless steels. While these materials have the capability to withstand continuous high temperatures, they typically are expensive and have low thermal conductivity that imparts additional challenges into the fired heater design.

In fired heater designs, it is generally desirable to minimize the pressure drop through the process heater. In some instances, the allowable pressure drop is so low that it is necessary to design process heaters with a low mass velocity in order to minimize the pressure drop through the heater tubing. The low mass velocity, however, can result in a reduced convective heat transfer coefficient, which may cause a large temperature rise across a relatively stagnant boundary film at the inside diameter of the tube. A large temperature rise across this boundary film tends to cause an increase in the tube wall temperature (TWT), which can result in a TWT that exceeds design limits of the tube metallurgy. Increasing the tube surface area, typically by increasing the tube length to reduce TWT, results in a greater pressure drop through the heater, which may require a further reduction of the mass velocity. Decreasing the mass velocity rate further results in a corresponding reduction in the heat transfer coefficient, which can increase the TWT further. As a result, heat transfer units for fired heater applications typically require multiple heating coils with a long length providing a sufficiently large surface area requiring substantial amounts of expensive materials (especially in high temperature circumstances) resulting in a process heater with a significant capital cost.

In conventional, tubular exchanger systems, heat transfer to the fluid may be improved using internal ribs, ridges, and/or grooves on the internal surfaces of tubes in order to increase the inner tube surface area. This provides increased heat transfer by conduction through the ribs, ridges, and/or grooves into the fluid core in addition to the heat transfer by convection via the flowing fluid. In systems using such ribs, ridges, and/or grooves, the flow regime in such systems typically are operated under conditions having a Reynolds Number (RE) less than about 250,000 and in some cases, much less than about 100,000. In such low RE flow regimes, applying internal ribs, ridges, and/or grooves can provide advantages to heat transfer, and generally the pressure drop through the tube due to the ribs, ridges, and/or grooves is not a significant concern due to the low velocities and relatively low levels of turbulence in the flow.

On the other hand, applying prior rib, ridge, and/or groove configurations to heat transfer units configured to operate at flow regimes having a high RE of about 250,000 or higher, such as a fired heater for catalytic naphtha reforming, generally results in a tube configuration with little or no advantage in heat transfer over a smooth walled tube equivalent. Such designs typically produce a significant pressure drop penalty associated with the ribbing, ridging, and/or grooving inside the tube due, among other factors, to the increased frictional contact between the fluid flow and the increased surface of the tube. In general, as the RE increases, the ratio of axial heat transfer from convection between ribs, ridges, and/or grooves relative to the radial heat transfer from conduction through the ribs, ridges, and/or grooves also increases. Such correlation indicates, as the RE increases in such systems, that there is a decreasing ability of the ribbing, ridging, and/or grooving to provide a benefit to the overall heat transfer via conduction relative to the heat transfer via convection. Accordingly, at such high RE ranges, it is generally understood that an internally ridged tube tends to exhibit the heat transfer performance of a bare tube equivalent (i.e., little improvement in heat transfer), and, at the same, time results in an undesirable increased pressure drop penalty. Thus, the heater tubes in a heat transfer unit operating at RE of about 250,000 or greater commonly do not include internal ribbing, ridging, and/or grooving because such structures provide little or no benefit to the heat transfer properties of the system and they produce pressure drop penalties and added capital cost.

Several studies have been reported of internal-axially-ridged tubes with empirical correlations for heat transfer and friction factor between the tube surface and the fluid flow. In one study, Kim and Webb suggested that an empirical correlation by Carnavos is the best available correlation for turbulent flow in axial and helical internally ridged tubes based on reliable data for air, water and water-glycol mixtures. (N. Kim and R. L. Webb, "Analytic Prediction of the Friction and Heat Transfer for Turbulent Flow in Axial Internal Fin Tubes," Journal of Heat Transfer, Vol. 115 (1993), pp. 553-559 and T. C. Carnavos, "Heat Transfer Performance of Internally Finned Tubes in Turbulent Flow," Heat Transfer Engineering, Vol. 1 (1980), pp. 32-37.) However, the range of Carnovos' data was limited to Prandlt Number (PR) of about $0.7 \leqq Pr \leqq 30$ and Reynolds Number (RE) of about $10{,}000 \leqq Re \leqq 100{,}000$. Such studies, therefore, provide little guidance for designing fired heaters in a RE flow regime of about 250,000 or greater.

In a fired heater configured for high temperatures and high RE, such as a fired heater for catalytic naphtha reforming, the heater configuration generally cannot be determined by only considering ridge configuration and process flow conditions. In many instances, configurations that may result in efficient heat transfer, low pressure drop, and satisfactory tube wall temperatures will also require long tube lengths or other designs that result in substantial amounts of expensive, exotic metals to construct suitable heaters for industrial use. As a result, a heater design that generally cannot provide improved heat transfer and decreased pressure drop for less material than an equivalent non-ridged heater is not desirable from a design or manufacturing standpoint. Such considerations are generally in contrast to the design of traditional steam boilers or heat exchangers at low RE and using more common materials, which do not result in a substantially negative effect to increased length and/or mass of the heater tubes.

SUMMARY

In one aspect, a heat transfer unit ("heater") is provided for increasing the temperature of process fluids, such as gas-phase fluids, having a Reynolds Number (RE) of at least about 275,000. The heater includes a conduit having the process fluids flowing therethrough and a heat source, such as a radiant heat source, providing an inconsistent heat flux along a length of the conduit where the heat source has a peak heat flux greater than an average heat flux. The conduit also includes one or more ridges formed on a portion of a conduit inner surface where the heater conduit with the ridges is effective to increase the temperature of the process fluid with a relatively low overall pressure drop and without exceeding a wall temperature limit of the material used to construct the conduit.

In another aspect, the ridges have configurations including selected parameters that are effective at such high RE conditions to improve (relative to a non-ridged conduit) the overall heat transfer ability of the conduit, without significantly increasing the overall pressure drop through the conduit (relative to a non-ridged conduit), and to maintain a wall temperature below the design limits of the conduit materials. Such conduit configurations are capable of achieving these results at RE conditions where it was previously believed ridging would not provide sufficient benefit in view of heat transfer, pressure drop, and cost considerations. At the same time, the conduit designs herein also preferably allow for a reduction in the quantity of conduit material required (relative to a non-ridged conduit) to achieve such advantages. In such aspect, the conduits herein have a shorter length or fewer coils than a non-ridged conduit heating substantially the same process fluid to substantially the same bulk temperature with substantially the same overall pressure drop and (even with less surface area of the conduit) without exceeding the wall temperature design limits of the materials used to design the heater.

In another aspect, the conduit has a configuration including one or more internal ridges having selected parameters that are effective to raise the temperature of the gas-phase fluid preferably flowing at RE of about 275,000 to about 1,000,000 and, most preferably, at RE of about 300,000 to about 500,000 through tubes or other conduit within the heater to temperatures of about 537° C. (1000° F.) or higher. In one such aspect, the conduit's configuration of ridging is also effective to limit the overall pressure drop through the conduit to about 27 kPa (4 psi) or less.

In another aspect, the conduit further has a configuration that is also capable of minimizing the temperature rise across a relatively stagnant boundary film at the inner surface of the conduit so that a wall temperature of the heater conduit does not exceed the design limits of the material used to construct the conduit, which in one instance is about 635° C. (1175° F.) or less. It will be appreciated, of course, that the conditions will vary depending on the fluids, conduit materials, heat source, and other variables. The reduction in the boundary film temperature is believed to be a result of a conduit configuration that is effective to reduce a temperature differential between the bulk gas fluid and the inside conduit wall while achieving the desired heat transfer and pressure drop requirements at the same time.

In yet other aspects, the conduit configuration includes the one or more ridges formed on at least a portion of the conduit inner surface adjacent to or corresponding to regions of highest heat flux. In such aspect, the ridges have selected parameters that generally define a preferred shape, size, length, and spacing thereof that are effective so that the conduit generally has a greater heat flux to the gas-phase fluid and substantially the same overall pressure-drop compared to the conduit without internal ridges having substantially the same gas-phase fluids flowing therethrough. The selected ridging configurations also have been discovered to provide these heat transfer and pressure drop advantages even at RE greater than about 275,000 where previously it was thought little or no benefit would be obtained from the conductive heat transfer effects of the ridges.

In still another aspect, the conduit is preferably constructed of materials capable of withstanding the tube wall temperature (TWT) design limits so that the bulk fluid can be heated to temperatures of about 537° C. (1000° F.) or greater. In such aspect, the materials are preferably metallic alloys capable of meeting the temperature requirements with a relatively low thermal conductivity, for example, about 16 Btu/hr/ft/° F. or less, and can have a relatively high cost. In this aspect, the preferred conduit configurations herein include an internal ridge configuration that is effective to provide improved heat transfer (relative to a non-ridged or substantially smooth inner walled or bare tube equivalent) to achieve temperatures of about 537° C. (1000° F.) and without exceeding the TWT limits for a gas-phase, RE flow regimes of at least about 275,000 that also provide for a reduced amount of heater material (relative to a bare tube equivalent) at a substantially fixed pressure drop and a substantially fixed inside wall temperature limit.

DETAILED DESCRIPTION

Figure 1:
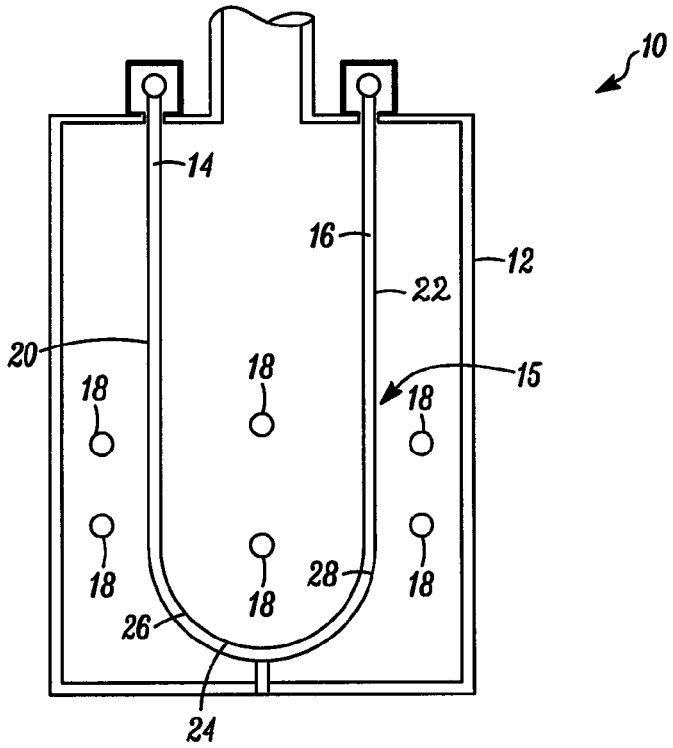
FIG. 1 is a schematic view of an exemplary heat transfer unit.

Turning to FIGS. 1 through 4, an exemplary heat transfer unit or heater 10 is illustrated in the form of a process furnace or fired heater that is effective to increase the temperature of a process fluid at Reynolds Number (RE) of at least about 275,000 that provides improved heat transfer at a substantially fixed pressure drop and a substantially fixed tube wall temperature (TWT) relative to prior heater designs at such high RE. In one aspect, the heater 10 includes a heater box 12, a conduit 14 extending through the heater box 12 and through which a process fluid 16 flows, and one or more heat sources 18 within the heater box 12. In one system, the one or more heat sources 18 are burners whose flames provide a radiant heat flux, which generally provides a variable or inconsistent heat flux, along the length of the conduit 14. This variable heat flux can provides a peak radiant heat flux adjacent the burners 18 with a decreasing heat flux the farther the conduit is from the burner 18. In some systems, the peak radiant heat flux can be up to about three times greater (in many cases about 1.5 times greater) than the average heat flux; however, the peak and average heat flux generally varies depending on the particular application and various heat transfer needs of the fluids.

In another aspect, the process fluid can include any hydrocarbonaceous stream such as, but not limited to, gas-phase hydrocarbonaceous streams, liquid-phase hydrocarbonaceous streams, and mixtures thereof. In yet another aspect, the process fluid inside the conduit 14 is preferably a gas-phase hydrocarbonaceous fluid including, for instance, a combination of light hydrocarbons and hydrogen having a Prandtl Number (PR) of about 0.8 or less. In one form, the heater may be arranged and configured as a fired heater for a catalytic naphtha reforming unit. However, the conduit configurations provided herein may also work on other fluids, other RE flow regimes, other PR fluids, and with other downstream operations.

In yet another aspect, the heater is capable of increasing the temperature of the gas phase fluid flowing through the conduit 14 to temperatures of about 573° C. (1000° F.) or greater. To achieve such temperatures, a radiant heat flux of up to about 100,000 Btu/hr/ft$^2$ (in some cases about 20,000 to about 100,000 Btu/hr/ft$^2$) is generally required from the burners 18. With such high temperatures and heat fluxes, the conduit 14 is preferably constructed of sufficient amounts of materials capable of withstanding such temperatures. Examples of suitable materials include 9Cr-1 Mo and/or 347H stainless steel; however, other materials meeting the temperature requirements may also be used. As discussed above, such materials generally have a thermal conductivity of about 16 Btu/hr/ft/° F., but such thermal conductivity may vary depending on the particular materials used.

As shown in FIG. 1, one configuration of the conduit 14 includes a generally U-shaped configuration formed from a pair of substantially straight leg portions 20 and 22 and a curved portion 24 connecting end portions 26 and 28 of the respective leg portions 20 and 22. While FIG. 1 shows only a single U-shaped conduit 14, it will be appreciated that conduit 14 may also include a plurality of U-shaped conduits 14 linked together in series or in parallel and/or may also include conduits, tubes, or other cavities of various shapes, sizes, and configurations as needed for a particular application.

Figure 2:
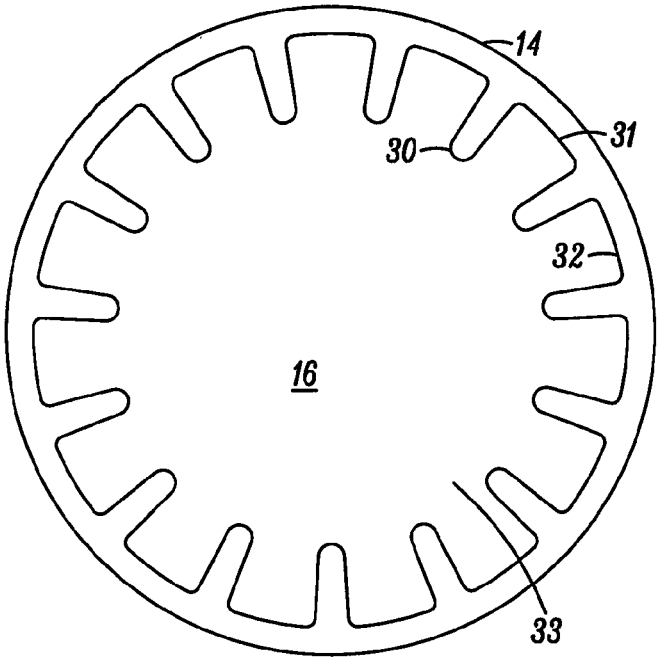
FIG. 2 is a cross-sectional view of an exemplary internally ridged conduit for use in the heat transfer unit of FIG. 1.
Figure 3:
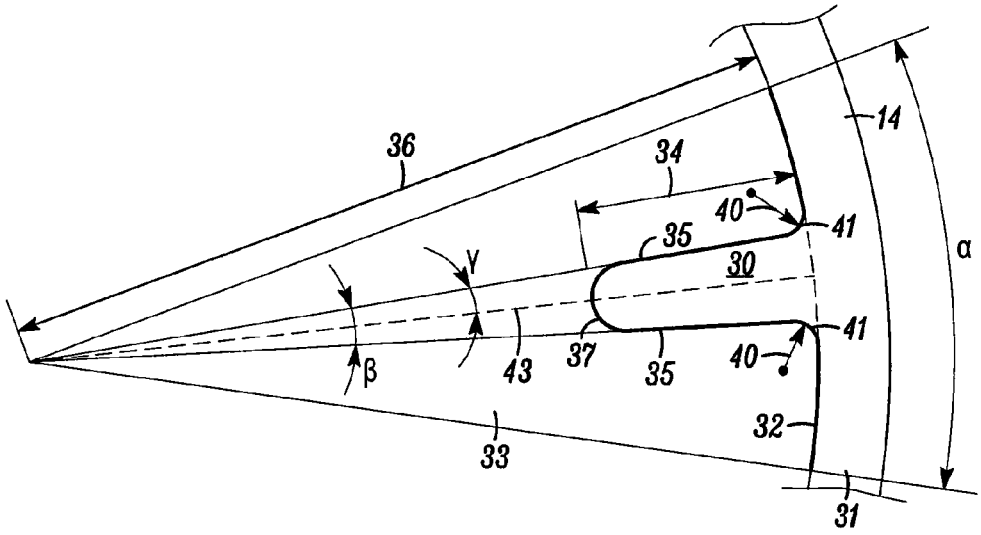
FIG. 3 is a partial, cross-sectional view of one exemplary internal ridge.
Figure 4:
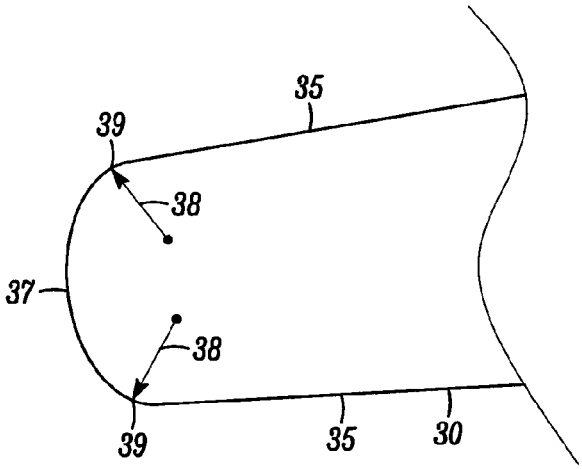
FIG. 4 is a partial, cross-sectional view of the tip of an exemplary internal ridge.

In another aspect, the conduit 14 includes one or more internal ridges 30 as generally illustrated in FIGS. 2 through 4. As discussed above, the ridges 30 have a configuration that includes selected parameters that are effective to provide the desired heat transfer, pressure drop, material requirements, and TWT benefits mentioned above. In such aspect, the conduit 14 is formed by an annular wall 31 enclosing an internal flow cavity 33 through which the gas-phase fluid flows. In this aspect, the ridge 30 is shown as a generally tapered, protruding finger extending a predetermined distance into the conduit cavity 33 from an internal surface 32 of the conduit annular wall 31. In the particular embodiment of FIG. 2, the conduit 14 includes 15 equally spaced ridges 30 about the internal surface 32 of the conduit. It will be appreciated, however, that the conduit 14 may also have varying numbers of the ridges 30 and/or spacing thereof depending on the particular application, material, and heat transfer needs. For instance, the conduit may have non-uniform spacing, ridging on only one side, and other non-symmetrical configurations of the ridges.

As best shown in FIGS. 3 and 4, exemplary configurations of the ridge 30 are illustrated. In this form, the ridge 30 generally includes spaced side walls 35 that taper towards each other as they extend away from the side wall 32 into the conduit cavity 33. A distal end wall 37 of the ridge 30 has curved transition regions 39 between the side walls 35 and the distal end wall 37 that provide for a smooth transition between the side and tip of the ridge. Between the side wall 35 and conduit inner wall 32, generally curved corners 41 are also included to provide a smooth transition to the inner wall 32. While not intending to be limited by theory, it is believed that the smooth transitions 39 and 41 are effective to prevent the formation of crevices that could lead to crack formation.

Referring to Table 1 below and FIGS. 3 and 4, additional details of exemplary ridges 30 are summarized. In such additional aspects, each ridge 30 can also be defined by a pie angle $\alpha$ that relates to the number of ridges 30 spaced about the internal surface 32 (i.e., number of ridges equals 360/pie angle), a base angle $\beta$ that relates to the taper between the side walls 35, and a side wall angle $\gamma$ that relates to the angle of inclination between the side wall and a radial axis 43. In addition, the ridges 30 may further be defined by a ratio of ridge height 34 to radius length 36, a tip radius curvature 38, a base radius curvature 40, and a total wall cross-sectional area through a section of the conduit with the ridges (unless otherwise specified). Such a cross-section is generally shown in FIG. 2. The cross-sectional area may be calculated as the cross-sectional area of tube wall combined with the cumulative cross-sectional area of each ridge. Of course, the ridges 30 can also be defined by other parameters.

TABLE 1

Exemplary Ridge Parameters

| Ridge Geometry Number | Pie Angle | Number of Ridges | Base Angle | Height-to-Radius Ratio | Tip Fillet Radius, inches | Base Fillet Radius, inches | Total Wall Outlet CSA, inch$^2$ |
|---|---|---|---|---|---|---|---|
| Bare | — | — | — | — | — | — | 0.010060 |
| 1 | 24 | 15 | 4 | 41.9 | 0.00050 | 0.00050 | 0.011330 |
| 2 | 24 | 15 | 12 | 41.9 | 0.00050 | 0.00050 | 0.013952 |
| 3 | 40 | 9 | 6.667 | 52.4 | 0.00050 | 0.00050 | 0.011489 |
| 4 | 24 | 15 | 4 | 27.9 | 0.00050 | 0.00050 | 0.010971 |
| 5 | 20 | 18 | 2 | 30.0 | 0.00050 | 0.00050 | 0.010638 |
| 6 | 24 | 15 | 4 | 22.0 | 0.00050 | 0.00050 | 0.010795 |
| 7 | 24 | 15 | 2 | 35.0 | 0.00050 | 0.00050 | 0.010593 |
| 8 | 40 | 9 | 3.4 | 52.4 | 0.00050 | 0.00050 | 0.010842 |
| 9 | 60 | 6 | 15 | 78.5 | 0.00050 | 0.00050 | 0.012853 |
| 10 | 36 | 10 | 2.3 | 45.6 | 0.00050 | 0.00050 | 0.010507 |
| 11 | 24 | 15 | 4 | 20.9 | 0.00050 | 0.00050 | 0.010763 |
| 12 | 24 | 15 | 1 | 60.0 | 0.00010 | 0.00050 | 0.010440 |
| 13 | 60 | 6 | 6.667 | 69.8 | 0.00050 | 0.00050 | 0.011233 |
| 14 | 45 | 8 | 22.5 | 30.0 | 0.00700 | 0.00700 | 0.013100 |
| 15 | 45 | 8 | 2 | 45.0 | 0.00050 | 0.00050 | 0.010403 |
| 16 | 24 | 15 | 4 | 14.0 | 0.00050 | 0.00050 | 0.010535 |
| 17 | 30 | 12 | 3.333 | 17.5 | 0.00050 | 0.00050 | 0.010460 |
| 18 | 24 | 15 | 12 | 3.5 | 0.00050 | 0.00050 | 0.010158 |
| 19 | 60 | 6 | 6.667 | 34.9 | 0.00050 | 0.00050 | 0.010793 |
| 20 | 9 | 40 | 3 | 5.2 | 0.00050 | 0.00050 | 0.010458 |
| 21 | 6 | 60 | 1 | 3.5 | 0.00010 | 0.00025 | 0.010195 |
| 22 | 6 | 60 | 3 | 2.6 | 0.00050 | 0.00050 | 0.010364 |
| 23 | 6 | 60 | 3 | 10.5 | 0.00050 | 0.00050 | 0.011233 |
| 24 | 6 | 60 | 1 | 0.9 | 0.00010 | 0.00010 | 0.010092 |
| 25 | 6 | 60 | 3.9 | 9.8 | 0.00050 | 0.00050 | 0.011488 |

In one aspect, as described in Examples 2 and 3 below and FIGS. 7 and 8, ridge geometries 6, 16, 17, and 18 of Table 1 and, preferably, ridge geometry 6 of Table 1, were estimated as being configured to minimize the amount of material needed to form the conduit 14 (i.e., cross-sectional areas and/or conduit length) and at the same time still be effective to increase the temperature of a gas-phase fluid with an improved heat transfer at substantially the same overall pressure drop as a conduit without internal ridging having the same gas-phase fluid flowing therethrough. At the same time, the conduit 14 with the ridging 30 is also effective to maintain a TWT below the design limits of the materials selected to form the conduit, such as a conduit formed from 9Cr-1 Mo with a TWT design limit of about 635° C. (1175° F.).

In other aspects, the ridges 30 are generally parallel to each other and continuously extend along a longitudinal axis of the conduit 14 for only a predetermined portion or length of the conduit, such as a portion 15 (FIG. 1) of the conduit 14 subjected to the peak radiant heat flux. For instance, ridge geometry 6, when disposed on about 15 to about 50 percent of the axial length of the heater conduit, is particularly effective to provide greater heat transfer and substantially the same overall pressure drop as a bare tube equivalent while at the same time permitting the heater conduit to be formed from a shorter length and/or less material without exceeding the TWT. In such aspect, the ridges 30 can extend a distance along the axial length of the heater conduit corresponding to the peak radiant heat flux, which can be, in some instances, up to about three times greater than the average heat flux. Preferably, the ridges 30 are positioned on the conduit longitudinal axes to correspond to the peak radiant heat flux and also a predetermined distance upstream and downstream from the peak flux. In one aspect, the distance the ridges 30 extend along the axial length of the conduit generally correspond to about 35 to about 50 percent of the axial length of one leg portion 22 (i.e., the outlet leg portion).

As generally shown in FIG. 2, it is preferred that the ridges 30 extend continuously along the longitudinal axis of the heater tube or at least the portion thereof. By one approach, the ridges 30 are preferably equally spaced about the internal surface 32 and extend parallel to each other along the longitudinal axis of the conduit. While not wishing to be limited by theory, it is believed that such configuration aids in the minimization of pressure drop through the heater. It will be appreciated, however, that the conduit 14 may also have varying numbers of ridges 30 and/or the spacing between the ridges may be non-uniform.

Additional advantages and embodiments of the heater and conduit configurations described herein are further illustrated by the following Examples. However, the particular conditions, flow schemes, materials, and amounts thereof recited in the Examples, as well as other conditions and details, should not be construed to unduly limit the conduit configurations described above and claimed. All percentages are by weight unless otherwise indicated.

EXAMPLES

Pressure drop and heat transfer for gas phase fluids flowing through an externally heated bare tube and internally-axial-ridged tube were modeled using computational fluid dynamics (CFD) software licensed from ANSYS. A preprocessing step was done with GAMBIT version 2.3.16. Processing and post-processing were done with FLUENT version 6.2.16. During the processing step, FLUENT's radiation model was not utilized. Turbulent properties in the fully turbulent region were calculated using the so-called realizable k-epsilon eddy viscosity model proposed by Shih et al. (T. Shih et al., "A New k-ϵ Eddy Viscosity Model for High Reynolds Number Turbulent Flows," Computer Fluids, Vol. 24 (1995), pp. 227-238.) The "cmu rotation" term in the k-epsilon eddy viscosity model was excluded by default. Turbulent properties in the near-wall region were calculated using FLUENT's enhanced wall treatment approach for compressible flow with heat transfer and pressure gradients. FLUENT's enhanced wall treatment approach assumes no slip at the wall. While certain software described above was used in this and the following examples, other CFD software may also be used.

Example 1

To verify the CFD methodology, studies were first completed to compare CFD results with the experimental lab data in McEligot (D. M. McEligot, "Effect of Large Temperature Gradients on Turbulent Flow of Gases in the Downstream Region of Tubes," Diss. Standford University (1963), Ann Arbor UMI (1963)), which provided experimental data for air flowing through a bare Hastelloy® X Alloy tube with about a 0.1228 inch inside diameter and about a 0.1670 inch outside diameter. In McEligot's study, the first three inches of the tube were unheated. Starting at the third inch, McEligot provided a relatively constant heat flux to the outside diameter of the tube. During McEligot's run number 52, air flowed through the tube at a Reynolds number of about 130,180 (based on average bulk properties over the interval between 7.178 inches and 8.676 inches from the tube's inlet) and McEligot provided a relatively constant heat flux of about 113,000 to about 115,000 Btu/hr/sqft to the outside diameter of the tube. From the data McEligot measured, McEligot was able to calculate the inside tube wall temperature at various positions along the length of the tube.

To validate the CFD methodology used in the following Examples, a 3D model of the first about 8.676 inches of McEligot's tube was constructed. Air properties were entered into FLUENT in the form of polynomials fit to air physical property data tabulated by McEligot at p. 167 of his thesis. Heat capacity and density data for Hastelloy X Alloy were provided by HAYNES International (H-3009A). Tube density was assumed to have a constant value of 513.216 pounds mass per cubic foot. The correlation for the tube's thermal conductivity correlation was taken from McEligot's appendix (p. 182) with the typographical error corrected such that the equation reads as shown in Equation A.

$$k=5.10+0.00622t \quad \text{A}$$

Figure 5:
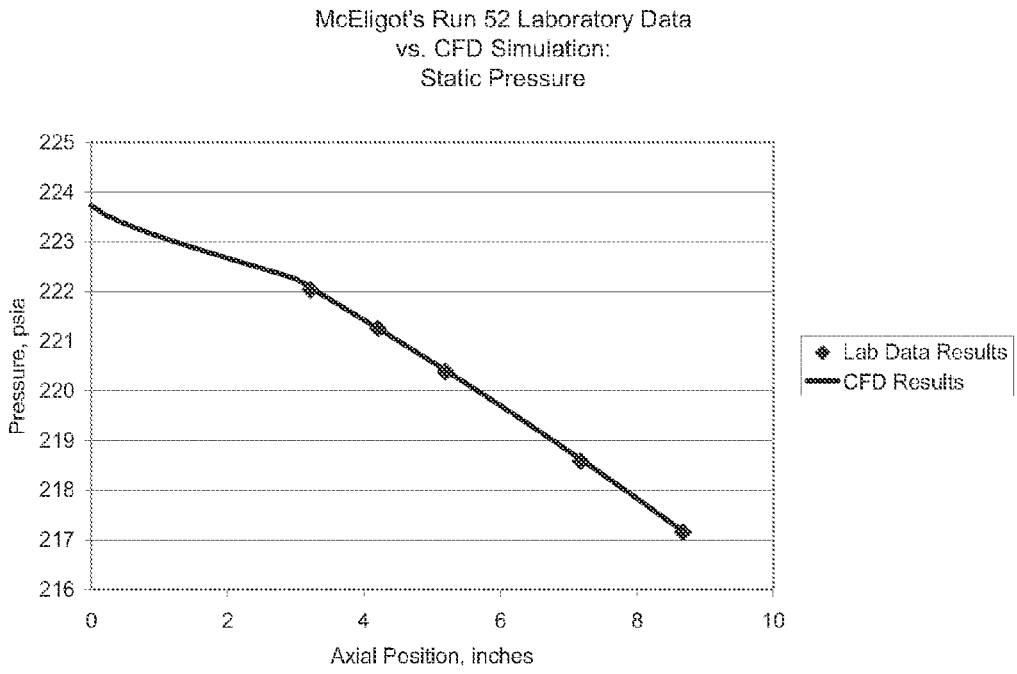
FIG. 5 is a chart of McEligot's Run 52 relative to a computational fluid dynamics (CFD) simulation of static pressure.

The static pressure profile predicted by the CFD model for air flowing through a bare tube is in excellent agreement with McEligot's Run 52 data (see FIG. 5). Based on data collected between about 7.178 inches and about 8.676 inches from the tube's inlet, McEligot calculated a friction factor of about 0.00407 in the manner of Humble et al. (see McEligot, pp. 58 and 148). Using the same approach (Equations C through F of Humble et al., pp. 346-347), a friction factor of about 0.00387 was calculated from CFD simulation results (see Table 2). The CFD based friction factor is about 95 percent of the friction factor McEligot calculated from his laboratory data and about 95 percent of the friction factor of about 0.00407 calculated using the adiabatic friction factor equation of Koo (Equation H, Koo, reported by McAdams on p. 155) for long smooth pipes with the temperature correction factor of McEligot et al. (Equation I, McEligot, Magee and Leppert, p. 71) applied.

Multiplying the CFD simulation based friction factor by four and applying the inverse of Equation I gives a Moody based friction factor of about 0.0163. Cross-referencing this friction factor with the Reynolds number of about 130,180 (based on average bulk properties over the interval) against Moody's friction factor chart (L. F. Moody, "Friction Factors For Pipe Flow," Transactions of the American Society of Mechanical Engineers, Vol. 66 (1944), pp. 671-678), it is seen that McEligot's Run 52 was conducted in the transition flow region.

$$D = \frac{4 \cdot A}{p} \quad \text{B}$$

$$G = \frac{m}{A} \quad \text{C}$$

$$\Delta P_{friction} = (p_1 - p_2) - \frac{G^2 \cdot R_{air}}{g} \cdot \left(\frac{t_{bulk_2}}{p_2} - \frac{t_{bulk_1}}{p_1}\right) \quad \text{D}$$

$$\rho_{avg} = \frac{1}{R_{air}} \cdot \left(\frac{p_1 + p_2}{t_{bulk_1} + t_{bulk_2}}\right) \quad \text{E}$$

$$f = \frac{g \cdot \rho_{avg} \cdot \Delta P_{friction}}{2 \cdot \frac{L}{D_i} \cdot G^2} \quad \text{F}$$

$$\text{Re} = \frac{4 \cdot m}{\pi \cdot \mu \cdot D} \quad \text{G}$$

$$f_{smooth_tube_adiabatic} = 0.00140 + \frac{0.125}{\text{Re}^{0.32}} \quad \text{H}$$

$$f_{corrected} = f_{adiabatic} \cdot \left(\frac{t_{id}}{t_{bulk}}\right)^{-0.1} \quad \text{I}$$

TABLE 2

Friction Factor Data from CFD Simulation of McEligot's Run 52

| Property | Units | CFD Results |
|---|---|---|
| Inside Radius | inch | 0.0614 |
| Wetted perimeter | ft | 3.215e−2 |
| Flowing Cross-Sectional Area | $ft^2$ | 8.255e−5 |
| Inside Diameter | ft | 1.023e−2 |
| Mass Flow Rate | $lb_m/hr$ | 54.98 |
| Mass Velocity (Eq C) | $lb_m/ft^2$ | 668,468 |
| Static Pressure at 7.178 inches | $lb_f/ft^2$ | 31482 |
| Static Pressure at 8.676 inches | $lb_f/ft^2$ | 31271 |
| Static Bulk Temperature at 7.178 inches | °R | 650 |
| Static Bulk Temperature at 8.676 inches | °R | 697 |
| Friction Pressure Drop (Eq D) | $lb_f/ft^2$ | 115.85 |

TABLE 2-continued

| Friction Factor Data from CFD Simulation of McEligot's Run 52 | | |
|---|---|---|
| Property | Units | CFD Results |
| Average Bulk Density (Eq E) | $lb_m/ft^3$ | 0.8736 |
| Friction Factor (Eq F) | — | 0.00387 |
| Adiabatic Friction Factor | — | 0.00407 |
| 4 x Adiabatic Friction Factor (Moody basis) | — | 0.0163 |
| Average Bulk Viscosity | $lb_m/ft/hr$ | 5.255e−2 |
| Average Reynolds Number (Eq G) | — | 1.302e+5 |
| Flow Regime from Moody's Chart (Laminar, Transition, Fully Turbulent) | — | Transition |
| Adiabatic Smooth Tube Friction Factor (Eq H) | — | 0.00429 |
| Temperature Corrected Smooth Tube Friction Factor (Eq I) | — | 0.00407 |

Figure 6:
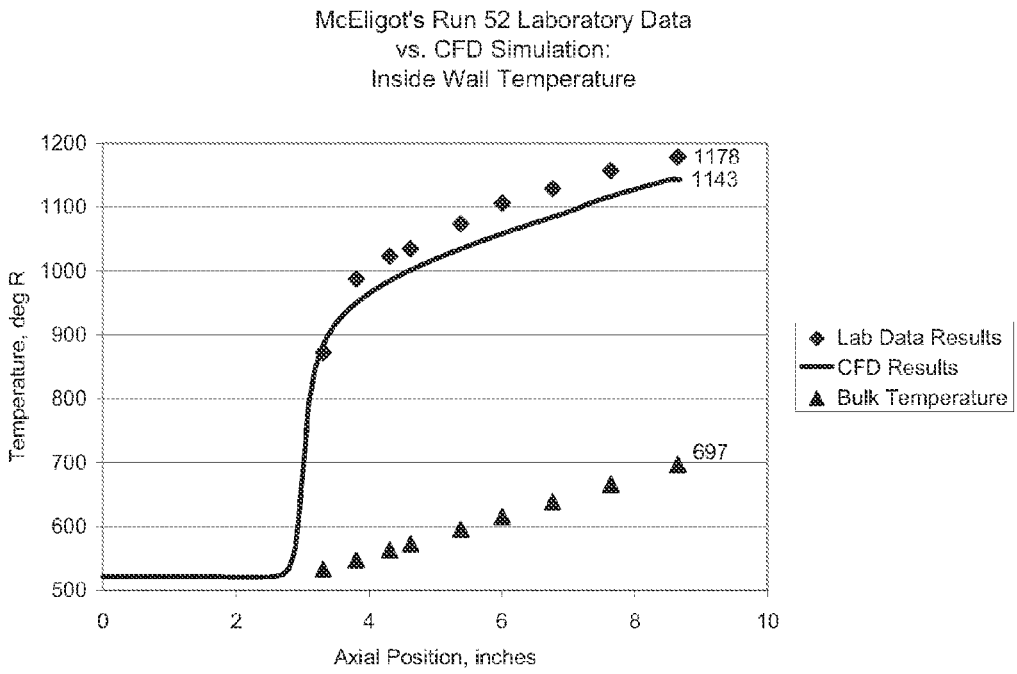
FIG. 6 is a chart of McEligot's Run 52 relative to a CFD simulation of inside wall temperature.

The slope of the CFD simulation inner tube wall temperature ("TWT") profile is similar to the slope of the TWT profile reported by McEligot for his Run 52 experiment (see FIG. 6). At about 8.676 inches from the tube inlet, the difference between the inner TWT and the bulk temperature from CFD simulation results is about 93 percent of that reported by McEligot. As a result, the local inside heat transfer coefficient calculated at the same position via Equation J (R. B. Bird et al., Transport Phenomena, Wiley, New York, 1960, p. 391) from the CFD simulation results is about 108 percent of the coefficient calculated from McEligot's Run 52 data (see Table 3). Similarly, the Stanton number (R. B. Bird et al., Transport Phenomena, Wiley, New York, 1960, p. 402) and Nusselt number calculated from CFD simulation results are both about 108 percent of the values calculated from McEligot's Run 52 data. Both the Stanton number calculated from McEligot's data and the Stanton number calculated from the CFD simulation results are on the order of about 80 percent of the Stanton number for turbulent flow in smooth pipes with constant heat flux (R. B. Bird et al., Transport Phenomena, Wiley, New York, 1960, p. 402 and FIG. 13.2-2 therein). As a result, the Nusselt number calculated from McEligot's data agrees with the Nusselt number calculated from McEligot's Nusselt number correlation (Equation O), while the Nusselt number calculated from CFD simulation results is about 105 percent of the value calculated from McEligot's Nusselt number correlation.

Considering the closeness of fit between calculated and measured friction factor and between calculated and measured Nusselt number, the CFD simulation methodology was deemed sufficient.

$$h_{loc_2} = \frac{q''}{t_{id_2} - t_{bulk_2}} \cdot \frac{0.1670}{0.1228} \quad \text{J}$$

In Equation J, the inside diameter basis heat flux has been replaced by the outside diameter heat flux. The right-hand side of Equation J has been multiplied by the ratio of the outside-to-inside diameters to compensate $$Pr = \frac{C_p \cdot \mu}{k} \quad \text{K}$$

$$St = \frac{h}{C_p \cdot G} \quad \text{L}$$

$$Nu = St \cdot \mathrm{Re} \cdot Pr \quad \text{M}$$

-continued $$Nu = \frac{h \cdot D_i}{k} \quad \text{N}$$

$$Nu = 0.021 \cdot \mathrm{Re}^{0.8} \cdot Pr^{0.4} \cdot \left(\frac{t_{bulk}}{t_{id}}\right)^{0.5} \cdot \left[1 + \left(\frac{x}{D}\right)^{-0.7}\right] \quad \text{O}$$

TABLE 3

| Heat Transport Properties Calculated at about 8.676 Inches from the Tube Inlet for Both McEligot's Run 52 Data and from the CFD Simulation of McEligot's Run 52 | | | |
|---|---|---|---|
| Property | Units | McEligot's Run 52 Data | CFD Results |
| Inside TWT at 8.676 inches | °R | 1178 | 1143 |
| Static Bulk Temperature at 8.676 inches | °R | 697 | 697 |
| Heat Flux, Inside Diameter Basis | $Btu/hr/ft^2$ | 113,385 | |
| Local Inside Heat Transfer Coefficient | $Btu/hr/ft^2/°R$ | 320.6 | 346.0 |
| Specific Heat Capacity at Constant Pressure | $Btu/lb_m/ft^3$ | 0.2429 | |
| Thermal Conductivity | Btu/hr/ft/°R | 0.01893 | |
| Prandtl Number | — | 0.6920 | |
| Stanton Number | — | 0.00197 | 0.00213 |
| Stanton Number for Turbulent Flow in Smooth Pipes with Constant Heat Flux | — | 0.0026 | |
| Reynolds Number | — | 126,896 | |
| Nusselt Number (Eq M) | — | 173.2 | 187.0 |
| Nusselt Number (Eq O) | — | 177.2 | 179.9 |

Example 2

Twenty five different ridge geometries were then evaluated by re-simulating McEligot's Run 52 twenty five times in 3D, using a different ridge geometry each time. The air flow rate, the heat flux to the outside diameter of the heated section, the outlet static bulk temperature, the outlet static pressure, and tube length where kept the same as in McEligot's Run 52. The radial heat flux to the heated section was set at about 111,460.5 $Btu/hr/ft^2$ (outside diameter basis).

To save on processing time, only the first four inches of the tube were simulated (three inches unheated and one inch heated). The ridge geometry for each simulation is provided in Table 4 below and the calculated results are provided in Table 5 below. To avoid round-off errors in GAMBIT, the preprocessing step included a scale factor that was reversed when the grid generated with GAMBIT was imported into FLUENT.

TABLE 4

Ridge Geometries Studied

| Ridge Geometry Number | Pie Angle | Number of Ridges | Base Angle | Height-to-Radius Ratio | Tip Fillet Radius, inches | Base Fillet Radius, inches | Total Wall Outlet CSA, inch$^2$ |
|---|---|---|---|---|---|---|---|
| Bare | — | — | — | — | — | — | 0.010060 |
| 1 | 24 | 15 | 4 | 41.9 | 0.00050 | 0.00050 | 0.011330 |
| 2 | 24 | 15 | 12 | 41.9 | 0.00050 | 0.00050 | 0.013952 |
| 3 | 40 | 9 | 6.667 | 52.4 | 0.00050 | 0.00050 | 0.011489 |
| 4 | 24 | 15 | 4 | 27.9 | 0.00050 | 0.00050 | 0.010971 |
| 5 | 20 | 18 | 2 | 30.0 | 0.00050 | 0.00050 | 0.010638 |
| 6 | 24 | 15 | 4 | 22.0 | 0.00050 | 0.00050 | 0.010795 |
| 7 | 24 | 15 | 2 | 35.0 | 0.00050 | 0.00050 | 0.010593 |
| 8 | 40 | 9 | 3.4 | 52.4 | 0.00050 | 0.00050 | 0.010842 |
| 9 | 60 | 6 | 15 | 78.5 | 0.00050 | 0.00050 | 0.012853 |
| 10 | 36 | 10 | 2.3 | 45.6 | 0.00050 | 0.00050 | 0.010507 |
| 11 | 24 | 15 | 4 | 20.9 | 0.00050 | 0.00050 | 0.010763 |
| 12 | 24 | 15 | 1 | 60.0 | 0.00010 | 0.00050 | 0.010440 |
| 13 | 60 | 6 | 6.667 | 69.8 | 0.00050 | 0.00050 | 0.011233 |
| 14 | 45 | 8 | 22.5 | 30.0 | 0.00700 | 0.00700 | 0.013100 |
| 15 | 45 | 8 | 2 | 45.0 | 0.00050 | 0.00050 | 0.010403 |
| 16 | 24 | 15 | 4 | 14.0 | 0.00050 | 0.00050 | 0.010535 |
| 17 | 30 | 12 | 3.333 | 17.5 | 0.00050 | 0.00050 | 0.010460 |
| 18 | 24 | 15 | 12 | 3.5 | 0.00050 | 0.00050 | 0.010158 |
| 19 | 60 | 6 | 6.667 | 34.9 | 0.00050 | 0.00050 | 0.010793 |
| 20 | 9 | 40 | 3 | 5.2 | 0.00050 | 0.00050 | 0.010458 |
| 21 | 6 | 60 | 1 | 3.5 | 0.00010 | 0.00025 | 0.010195 |
| 22 | 6 | 60 | 3 | 2.6 | 0.00050 | 0.00050 | 0.010364 |
| 23 | 6 | 60 | 3 | 10.5 | 0.00050 | 0.00050 | 0.011233 |
| 24 | 6 | 60 | 1 | 0.9 | 0.00010 | 0.00010 | 0.010092 |
| 25 | 6 | 60 | 3.9 | 9.8 | 0.00050 | 0.00050 | 0.011488 |

TABLE 5

Calculated Results

| Ridge Geometry Number | Delta Pressure Ratio from FLUENT | Delta Temperature Ratio from FLUENT |
|---|---|---|
| Bare | — | — |
| 1 | 3.07 | 0.488 |
| 2 | 6.13 | 0.394 |
| 3 | 2.72 | 0.531 |
| 4 | 1.93 | 0.58 |
| 5 | 2.00 | 0.598 |
| 6 | 1.65 | 0.629 |
| 7 | 2.12 | 0.615 |
| 8 | 2.46 | 0.593 |
| 9 | 3.34 | 0.532 |
| 10 | 2.25 | 0.637 |
| 11 | 1.62 | 0.683 |
| 12 | 3.04 | 0.627 |
| 13 | 2.15 | 0.67 |
| 14 | 2.51 | 0.622 |
| 15 | 1.72 | 0.728 |
| 16 | 1.33 | 0.76 |
| 17 | 1.29 | 0.768 |
| 18 | 1.19 | 0.849 |
| 19 | 1.38 | 0.808 |
| 20 | 1.19 | 0.912 |
| 21 | 1.12 | 0.943 |
| 22 | 1.11 | 0.969 |
| 23 | 1.58 | 0.901 |
| 24 | 1.00 | 1.023 |
| 25 | 1.89 | 0.934 |

During the processing step using FLUENT, the radial edges of the grid pattern were defined as periodic boundaries such that the entire 360 degree cross section was modeled. The temperature difference between the inside of the tube wall and the bulk static temperature was calculated at the outlet. Pressure drop was calculated between the third inch (i.e., the start of the heated section) and the outlet.

For this screening test, the Delta Pressure Ratio (Equation Q) and the Delta Temperature Ratio (Equation R) were calculated at a fixed tube length and fixed mass flow for each simulation of the 25 geometries. The screening calculation results are tabulated above in Table 5 and plotted in FIG. 7.

$$\Delta p = p_{axial_inch_3} - p_{axial_inch_4} \quad \text{P}$$

$$\text{"Delta } P \text{ Ratio"} = \frac{\Delta p_{ridged_tube_simulatio}}{\Delta p_{bare_tube_simulation}} \quad \text{Q}$$

$$\text{"Delta } T \text{ Ratio"} = \frac{(t_{id} - t_{bulk})_{ridged_tube_simulation}}{(t_{id} - t_{bulk})_{bare_tube_simulation}} \quad \text{R}$$

Figure 7:
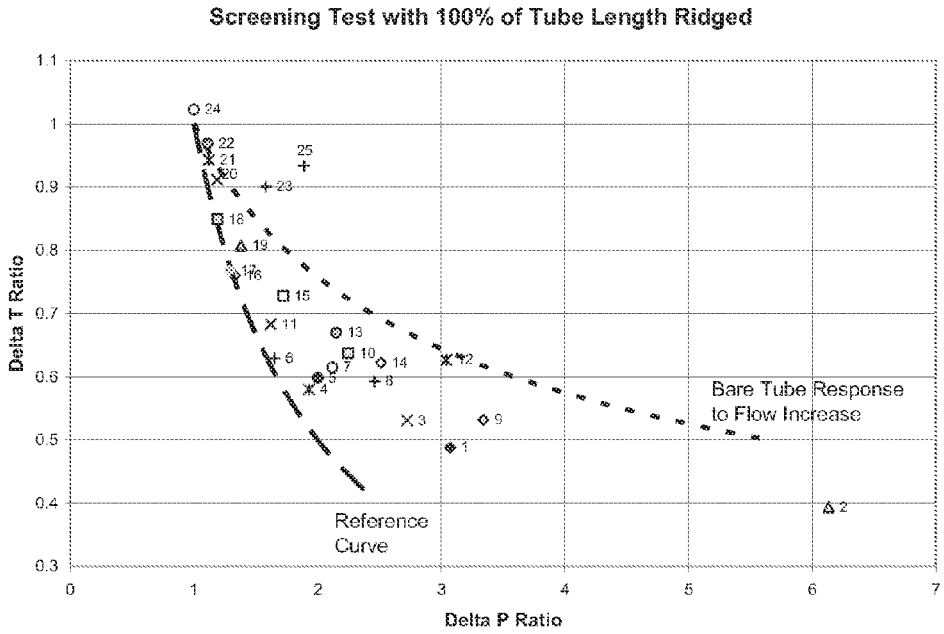
FIG. 7 is a chart of a delta temperature ratio against a delta pressure ratio for a CFD screening assuming about 100 percent of the conduit length is ridged.

The data points on FIG. 7 represent how a heater tube would perform at screening calculation conditions if about 100 percent of the tube length was ridged. Two curves are also shown on FIG. 7. The top curve shows the response a bare tube would have if the mass flow was increased while the heat flux and length remained constant. For the case of about 100 percent of the tube length being ridged, ridge geometries with points above this curve would be detrimental in the heater design process because there is no benefit gained over a non-ridged tube. The lower curve, labeled "Reference Curve", shows the set of idealized ridge geometries that, if exist, would allow the heater designer to take advantage of the improved heat transfer afforded by the ideal ridge to reduce the length of one tube and still get the same TWT as the reference bare tube while at the same time balancing the psi/ft penalty associated with the ridge against the fact that tube length would be reduced such that the pressure drop across the entire ridged tube is the same as the pressure drop across the entire reference bare tube. At a constant mass flow rate, the Reference Curve can be simplified as the following equation:

Baseline Delta T Ratio=1/(Baseline Delta P Ratio)

where the Baseline Delta T Ratio is the Delta T Radio calculated for a 100 percent ridged tube for the particular ridge configuration, and the Baseline Delta P Ratio is the Delta P Ratio calculated for a 100 percent ridged tube for the particular ridge configuration and with the base mass flow. Preferred ridge designs would approach the reference curve of FIG. 7.

If one wanted to design a heater with uniform heat flux along the length of the tubes and wanted to reduce the tube length while keeping the TWT and pressure drop equal to the bare tube equivalent, ridge geometries 6, 16, 17, and 18 would be preferred at screening calculation conditions because they are closest to the ideal Reference Curve in FIG. 7.

Example 3

To help determine which ridge geometry should receive more in depth attention, the percentage of tube length with internally-axial ridges was set at about 50 percent for each ridge geometry. By simultaneously solving Equation S and Equation T, the total tube length and mass flow through the tube were calculated to keep the TWT and total tube pressure drop substantially equal to the bare reference tube. In equations S and T, as discussed above, the Baseline Delta T Ratio is the Delta T Radio calculated for a 100 percent ridged tube for the particular ridge configuration, and the Baseline Delta P Ratio is the Delta P Ratio calculated for a 100 percent ridged tube for the particular ridge configuration and with the base mass flow. A Tube Cost Ratio (Equation V) was then calculated for each simulation. The results are tabulated in Table 6 and plotted in FIG. 8.

$$\frac{L_{base}}{L_{new}} \cdot \frac{m_{new}^{0.2}}{m_{base}^{0.2}} \cdot \text{"Baseline Delta } T \text{ Ratio"} = 1 \qquad \text{S}$$

$$\frac{L_{new}}{L_{base}} \cdot \frac{m_{new}^{2}}{m_{base}^{2}} \cdot [\text{"fraction ridged"} \cdot (\text{"Baseline Delta } P \text{ Ratio"}) + 1 - \text{"fraction ridged"}] = 1 \qquad \text{T}$$

$$\text{"Metal Ratio"} = \frac{\text{"Tube wall cross-sectional area for a ridged tube"}}{\text{"Tube wall cross-sectional area for a bare tube"}} \qquad \text{U}$$

$$\frac{\text{Tube_Cost}_{new}}{\text{Tube_Cost}_{old}} = \frac{m_{base}}{m_{new}} \cdot \frac{L_{new}}{L_{base}} \cdot ((\text{"fraction ridged"} \cdot \text{Metal_Ratio} + 1 - \text{"fraction ridged"}) \qquad \text{V}$$

TABLE 6

Screening Test with About 50 Percent of Conduit Ridged

| Ridge Geometry Number | Single U-Conduit Length,* feet | Mass Flow, $lb_m$/hr | Change in Total Conduit Length (relative to bare tube equivalent), % | Tube Cost Ratio for 50% of Length Ridged |
|---|---|---|---|---|
| Bare | | | — | — |
| 1 | 0.49 | 1.00 | 0.0 | 0.52 |
| 2 | 0.38 | 0.86 | +16.3 | 0.53 |
| 3 | 0.53 | 1.00 | 0.0 | 0.57 |
| 4 | 0.59 | 1.07 | −6.6 | 0.58 |
| 5 | 0.61 | 1.05 | −4.5 | 0.60 |
| 6 | 0.65 | 1.08 | −7.4 | 0.62 |
| 7 | 0.62 | 1.02 | −1.8 | 0.62 |
| 8 | 0.59 | 0.99 | +1.3 | 0.62 |
| 9 | 0.52 | 0.94 | +6.3 | 0.63 |
| 10 | 0.64 | 0.98 | +1.7 | 0.66 |
| 11 | 0.69 | 1.04 | −4.2 | 0.68 |
| 12 | 0.61 | 0.90 | +11.1 | 0.70 |
| 13 | 0.66 | 0.98 | +2.3 | 0.72 |

TABLE 6-continued

Screening Test with About 50 Percent of Conduit Ridged

| Ridge Geometry Number | Single U-Conduit Length,* feet | Mass Flow, $lb_m$/hr | Change in Total Conduit Length (relative to bare tube equivalent), % | Tube Cost Ratio for 50% of Length Ridged |
|---|---|---|---|---|
| 14 | 0.61 | 0.96 | +3.8 | 0.73 |
| 15 | 0.73 | 1.00 | 0.0 | 0.74 |
| 16 | 0.77 | 1.05 | −4.8 | 0.75 |
| 17 | 0.78 | 1.06 | −5.3 | 0.76 |
| 18 | 0.85 | 1.04 | −3.8 | 0.82 |
| 19 | 0.81 | 1.02 | −2.0 | 0.82 |
| 20 | 0.91 | 1.00 | 0.0 | 0.93 |
| 21 | 0.94 | 1.00 | 0.0 | 0.95 |
| 22 | 0.97 | 0.99 | +1.1 | 0.99 |
| 23 | 0.90 | 0.93 | +7.7 | 1.03 |
| 24 | 1.02 | 0.99 | +1.2 | 1.04 |
| 25 | 0.91 | 0.87 | +14.9 | 1.12 |

*Length of conduit relative to a bare conduit equivalent when 50 percent of conduit is ridged.

Figure 8:
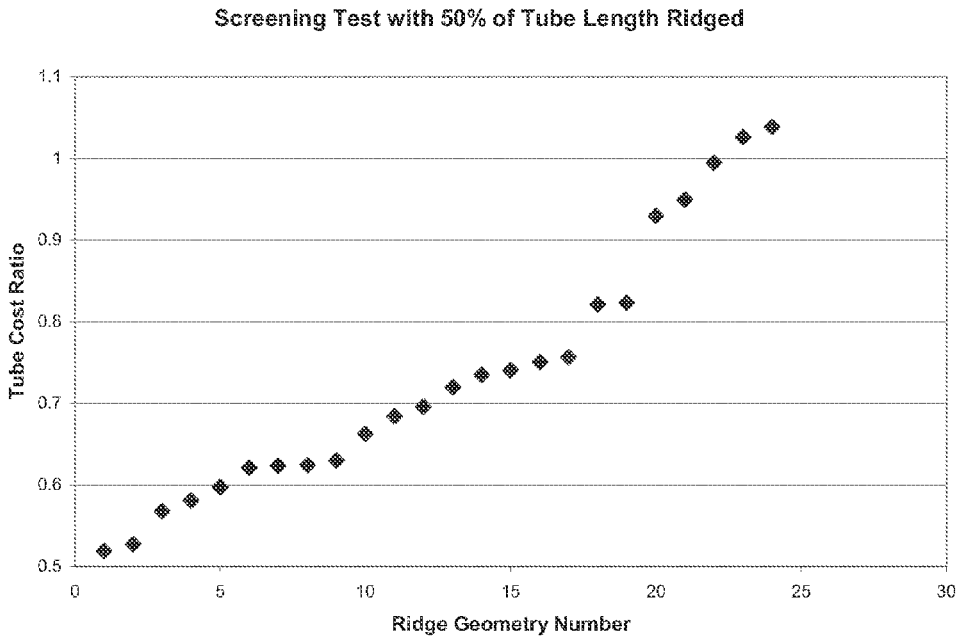
FIG. 8 is a chart of tube cost ratio of a CFD screening test assuming about 50 percent of the conduit length being ridged.
Figure 12:
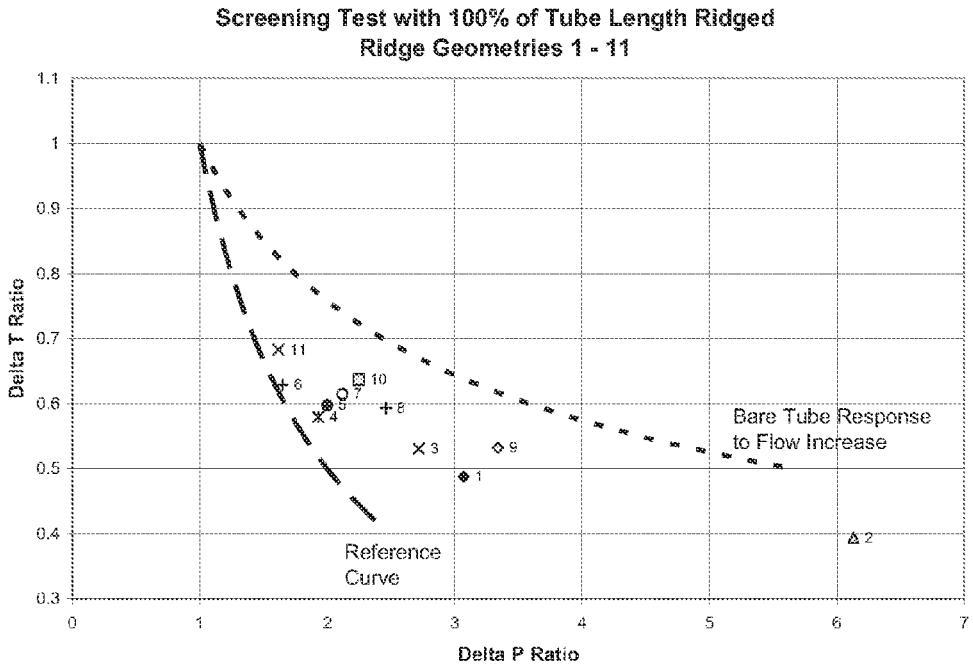
FIG. 12 is a chart of a delta temperature ratio against a delta pressure ratio for a CFD screening assuming about 100 percent of the conduit length being ridged for group I of ridge geometries.
Figure 13:
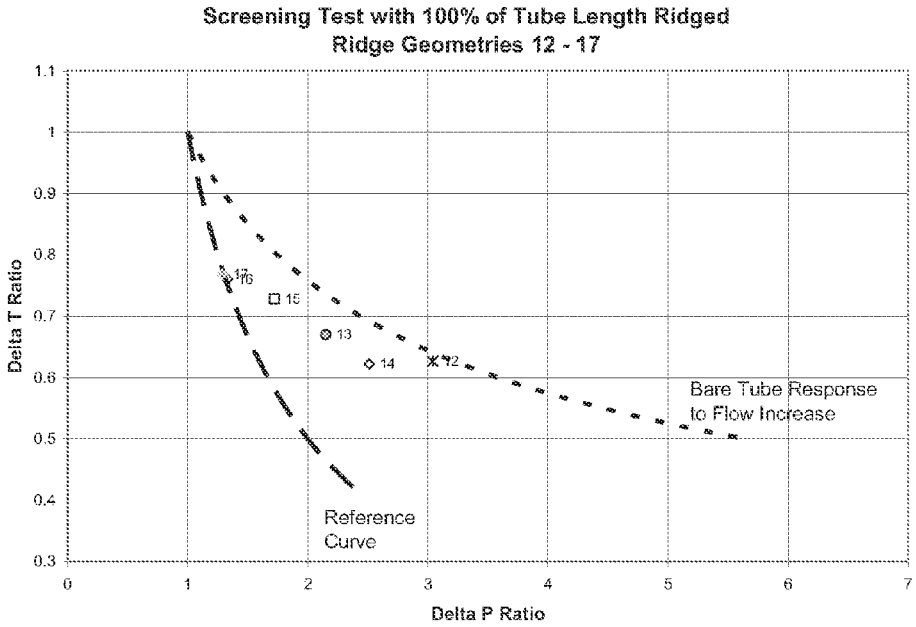
FIG. 13 is a chart of a delta temperature ratio against a delta pressure ratio for a CFD screening assuming about 100 percent of the conduit length being ridged for group II of ridge geometries.
Figure 14:
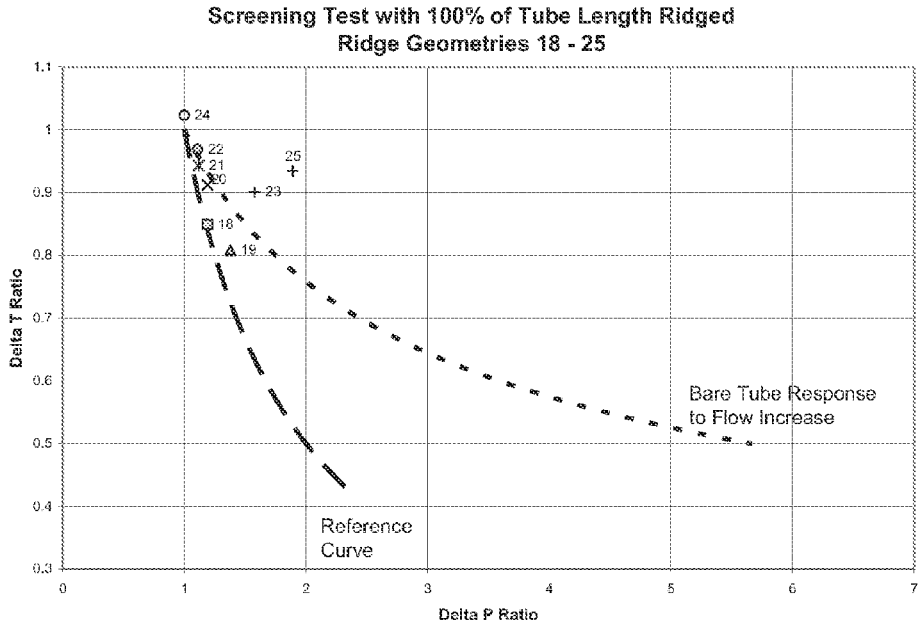
FIG. 14 is a chart of a delta temperature ratio against a delta pressure ratio for a CFD screening assuming about 100 percent of the conduit length being ridged for group III of ridge geometries.

Looking at FIG. 8, the ridge geometries can be grouped into three general categories—group I (ridge geometries 1-11), group II (ridge geometries 12-17) and group III (ridge geometries 18-25). Each category is replotted separately on Delta Temperature vs. Delta Pressure graphs as shown in FIGS. 12-14. The differences in Delta Temperature Ratios are fairly distinct. The group I geometries all produced a Delta Temperature Ratio less than 0.7 in the screening calculation of Example 2, the group II geometries produced a Delta Temperature Ratio between 0.6 and 0.8 in the screening calculation, and the group III geometries all produced a Delta Temperature Ratio greater than 0.8 in the screening calculation.

Looking at the number of ridges, base angle, and height-to-radius ratio for each of the 25 ridge geometries, there are no strong patterns to suggest ahead of time whether a proposed geometry will be classified as group I, II, or III. As shown in Table 7, ridge geometry 6 (group I) looks very similar to ridge geometry 16 (group II), ridge geometry 8 (group I) looks very similar to ridge geometry 15 (group II), and ridge geometry 19 (group III) bares no resemblance to ridge geometry 24 (group III). In one aspect, group I ridge configurations provide for a heater conduit with less material than group II configuration, and group II configurations provide for a ridge configuration with less material than group III configurations.

TABLE 7

Comparison of Six Example Ridge Geometries Classified by Group

| Ridge Geometry | Group | Number of Ridges | Base Angle | Height-to-Radius Ratio |
|---|---|---|---|---|
| 6 | I | 15 | 4 | 22.0 |
| 16 | II | 15 | 4 | 14.0 |
| 8 | I | 9 | 3.4 | 52.4 |
| 15 | II | 8 | 2 | 45.0 |
| 19 | III | 6 | 6.667 | 34.9 |
| 24 | III | 60 | 1 | 0.9 |

Based on the results of the screening test and tube length/mass flow calculations, ridge geometry 6 was selected for further investigation at conditions suitable for a process fired heater. Ridge geometry 6 was selected because it was identified as a low cost geometry of group I (i.e., tube cost ratio in FIG. 8 below 1.0) while at the same time its screening test results (Example 2) placed it near the ideal reference line in FIG. 7.

Example 4

Ridge geometry 6 was then further investigated at the following conditions: (1) the tube model and ridge geometry were scaled to about a 5 inch Sch 40 AW tube and (2) the first about 130 inches were left unheated followed by about 70 inches of heated section.

In preparation for the CFD processing step, a hydrogen-hydrocarbon mix representative of the fluid flowing through the heater was simulated using Hysys Version 3.2 with the Peng-Robinson physical property package selected. The fluid was flashed at about 80 psig and a range of temperatures. Polynomials were then fit to physical property data for the fluid. Hastelloy X Alloy properties were used to define the tube material.

Figure 9:
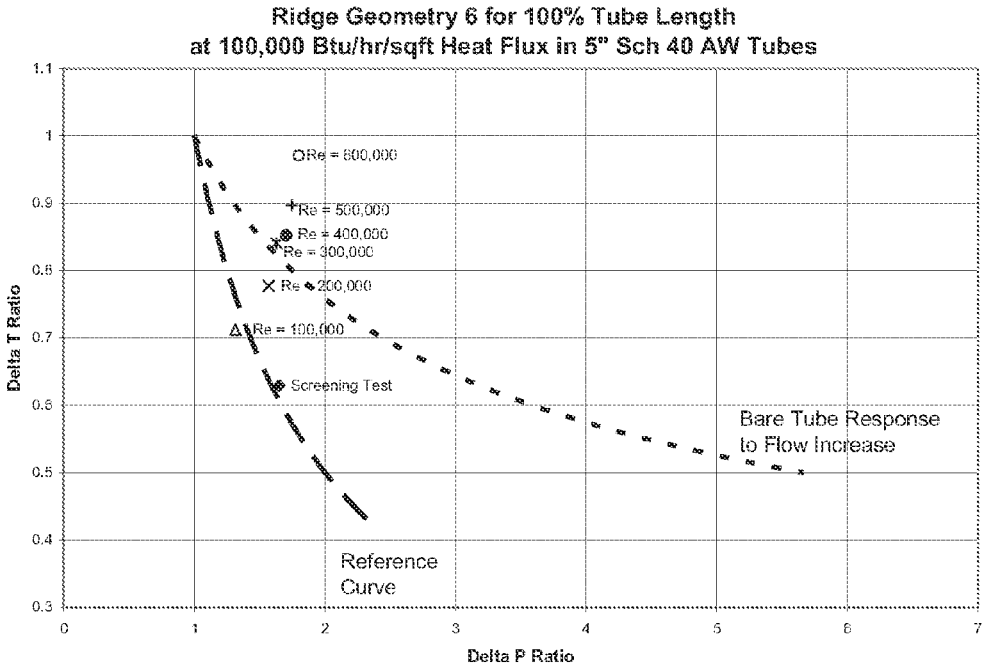
FIG. 9 is a chart of a delta temperature ratio against a delta pressure ratio for a CFD simulation of ridge geometry 6 at various RE.
Figure 10:
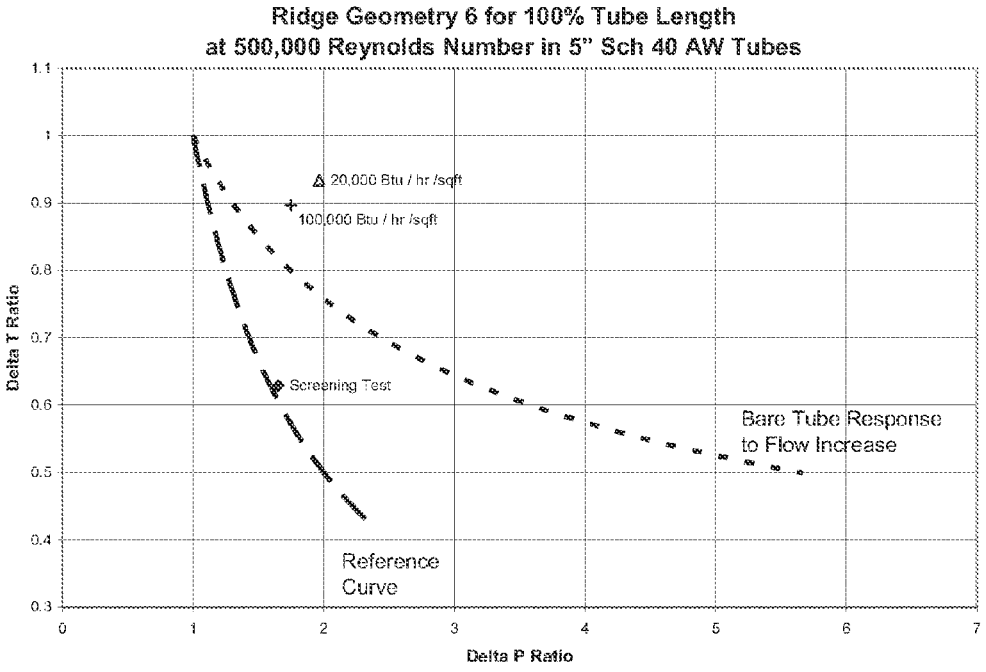
FIG. 10 is a chart of a delta temperature ratio against a delta pressure ratio for a CFD simulation of ridge geometry 6 at various heat flux rates.

A matrix of heater conditions was generated for use in the simulations. First, the heat flux to the outside of the tube in the heated section was held constant and the Reynolds number of the fluid was varied between about 100,000 and about 800,000 (FIG. 9). Second, the Reynolds number was held constant and the heat flux was varied (FIG. 10). At each condition, a bare tube simulation was run followed by a ridged tube simulation such that the bare tube simulation results could be used as a basis of comparison. The Reynolds number for each simulation was reported on a bare tube basis.

A static bulk temperature of about 543° C. (1010° F.) and a static pressure of about 80 psig were targeted for the point about 165 inches from the tube inlet (i.e., the mid point of the heated section). Tube inlet and outlet boundary conditions were then estimated based on a smooth bare tube's response to the flow rate and external heat flux used for each simulation. The resulting simulation results showed a temperature and pressure at the about 165th inch close to the targeted values. The Reynolds number for each simulation was calculated based on the targeted temperature and pressure at the about 165th inch. The temperature difference between the inside of the tube wall and the bulk static temperature was also calculated at the outlet 165th inch and pressure drop was calculated between the about 130th inch (i.e., the start of the heated section) and the about 165th inch.

The Delta Temperature Ratio versus Delta Pressure Ratio results of simulating both about a 5 inch Sch 40 AW bare tube and about a 5 inch Sch 40 AW tube with ridge geometry 6 at about 100,000 Btu/hr/sqft heat flux with a hydrogen-hydrocarbon mixture flowing through at different Reynolds numbers (bare tube basis) are shown in FIG. 9.

In examining FIG. 9, two trends are apparent. First, when the lowest Reynolds number data point is compared to the screening test results, it is believed that increasing the tube diameter while at the same time changing the Prandtl number of the material flowing through the tube causes the Delta Temperature Ratio to increase and the Delta Pressure Ratio to decrease. In other words, increasing the tube diameter appears to cause the ridged tube to behave more like the bare tube.

Second, increasing the Reynolds number results in an increase in both the Delta Temperature Ratio and the Delta Pressure Ratio. Essentially, increasing the Reynolds number causes a decrease in the ridge tube's heat transfer effectiveness while at the same time continuing increasing the pressure drop penalty associated with ridging the tube. As shown in FIG. 9, at Reynolds numbers exceeding about 250,000, better use of such a pressure drop increase can be had with a bare tube than with a tube with about 100 percent of the tube length ridged with ridge geometry 6 because all points fall above the bare tube upper limit curve.

The reason for the increase in Delta Temperature Ratio with increasing Reynolds number can be seen by comparing the rate of axial heat flow via convection in the crater between the ridges vs. rate of radial heat flow via conduction in the ridge as shown in Equation X and Table 8. Heat transfer properties averaged over the characteristic length were used in calculating the ratios.

As the Reynolds increases from about 400,000 to about 800,000, the ratio of heat flow rates increases. Taken to the extreme, the trend implies that at infinite Reynolds number the ratio of heat flux values would tend to infinity and the heat transfer performance of the ridged tube would equal that of a bare tube. In making this comparison, the impact of radial and tangential heat transfer within the crater area is ignored. This simplification is justified based on the fact that the axial Peclet number (Equation W) (See, e.g., D. Gidaspow, Computational Transport, Chapter 1, Unpublished textbook, 2006) for fluid flowing in the crater area between the ridges is much greater than unity in the range of Reynolds numbers being considered as shown in Table 8.

TABLE 8

Rate of Axial Heat Flow via Convection in the Crater Between the Ridges vs. Rate of Radial Heat Flow via Conduction in the Ridge for Constant Heat Flux

| Reynolds Number (bare tube basis) | 400,000 | 500,000 | 800,000 |
|---|---|---|---|
| Axial Peclet Number (Eq W) | 15,350 | 19,687 | 34,680 |
| Ratio of Heat Flow Rates (Eq X) | 102 | 134 | 238 |

$$Pe_{axial} = \frac{\rho_{fluid} v_{axial} \cdot C_{p\,fluid} \cdot L_{\text{ridge_height}}}{k_{fluid}} \qquad \text{W}$$

$$\frac{\text{"rate of axial heat flow via convection"}}{\text{"rate of radial heat flow via conduction in the ridge"}} = Pe_{axial} \cdot \frac{k_{fluid}}{k_{metal}} \qquad \text{X}$$

Increasing the Reynolds number results in an increase in both the Delta T Ratio and the Delta P Ratio. As before, the reason for the increase in Delta T Ratio with increasing Reynolds number can be seen by comparing the rate of axial heat flow via convection in the crater between the ridges vs. rate of radial heat flow via conduction in the ridge as shown in Equation X and Table 8. Heat transfer properties averaged over the characteristic length were used in calculating the ratios.

The Delta Temperature Ratio versus Delta Pressure Ratio results of simulating both about a 5 inch Sch 40 AW bare tube and about a 5 inch Sch 40 AW tube with ridge geometry 6 at a Reynolds number of about 500,000 (bare tube basis) at two different heat fluxes with a hydrogen-hydrocarbon mixture flowing through are shown in FIG. 10.

As the heat flux is decreased from 100,000 to 20,000 Btu/hr/sqft, the ratio of heat flow rates increases. Taken to the extreme, as the heat flux approaches zero the ratio of heat flux values would tend to infinity and the heat transfer performance of the ridged tube would equal that of a bare tube as shown in Table 9.

TABLE 9

Rate of Axial Heat Flow via Convection in the Crater Between the Ridges vs. Rate of Radial Heat Flow via Conduction in the Ridge for Constant Reynolds Number

| Heat Flux | Btu/hr/sqft | 20,000 | 100,000 |
|---|---|---|---|
| Axial Peclet Number (Eq W) | — | 22,890 | 19,687 |
| Ratio of Heat Flow Rates (Eq X) | — | 156 | 134 |

Example 5

Ridge geometry 6 was further analyzed at less than about 100 percent of the tube length with a fixed overall pressure drop and fixed TWT. In this example, the percentage of tube length with continuous internally-axial ridges was set at about 15 percent of the overall tube length for ridge geometry 6. For a U-shaped tube (commonly used in heater design) with about a 40 foot long straight length and about a 6 foot bend radius, about 15 percent ridging of the total tube is equivalent to ridging about 37 percent of the outlet leg of the U-shape, which would correspond to or be adjacent to the high or peak radiant heat flux portion of the heater. In this configuration, therefore, the majority of the high flux portion of the outlet leg of the tube should be able to be addressed with internally-axial ridges.

Figure 11:
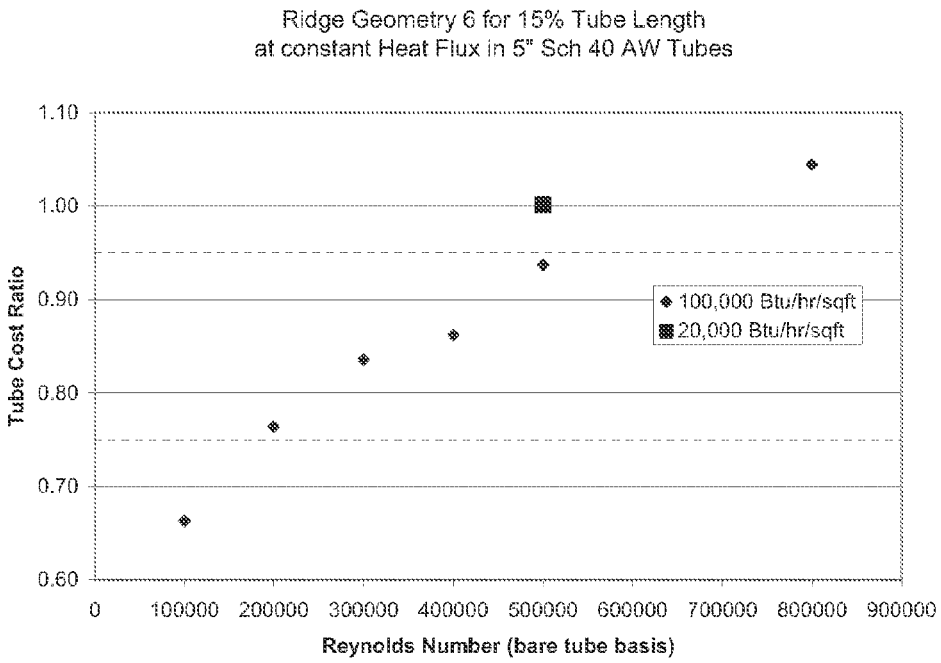
FIG. 11 is a chart of tube cost ratio of ridge geometry 6 for about 15 percent of the heater conduit length ridged at various RE.

As done during the screening test, Equation S and Equation T were solved simultaneously to find the total tube length and mass flow through the tube needed to keep the TWT and overall tube pressure drop equal to the bare tube reference (i.e., TWT and total tube pressure drop were fixed). The Tube Cost Ratio (Equation V) was then calculated for each simulation. The results are plotted in FIG. 11, which shows ridge geometry 6 with about 15 percent of the tube ridged as being capable of providing a TWT and an overall tube pressure drop equal to a bare tube reference with less material (i.e., lower cost) up to RE of about 500,000.

Limiting the percentage of tube length with ridge geometry 6 to about 15 percent of the overall length of the conduit (i.e., a portion of the conduit with the highest radial heat flux in this case) makes it possible to design a heater tube that uses up to about 16 percent less material at a RE of about 300,000 and a radial heat flux of about 100,000 Btu/hr/ft$^2$ by increasing the flow through the tube by about 5 percent (by decreasing the number of parallel flow passes by about 5 percent) and reducing the tube length in each pass by 16 percent. In this example, fired heater tubes for use with catalytic naphtha reforming heater service can be designed with less material than a bare tube equivalent using internal-axially-ridged tubes producing substantially the same tube wall temperature and pressure drop as a bare tube equivalent. Ridge geometry 6, with 15 axial ridges, each ridge having a base equal to four degrees of the bare tube inside diameter and each having a ridge height to bare tube radius ratio of about 22 was identified as being a preferred design. In one aspect, because of the tendency of the ridge tube to become less effective in transferring heat at elevated Reynolds numbers and low heat flux values, the experiments show that it is preferred the ridged part of the heater tube should be designed in the about 300,000 to about 500,000 Reynolds number range and the flux rates in excess of about 20,000 Btu/hr/sqft; however, other conditions are also possible depending on the particular application.

The foregoing description and drawing figures clearly illustrate the advantages encompassed by the processes described herein and the benefits to be afforded with the use thereof. In addition, the drawing figures are intended to illustrate exemplary flow schemes and resultant data of the processes described herein. Other processes, outcomes, and flow schemes are, of course, also possible. It will be further understood that various changes in the details, materials, and arrangements of parts and components which have been herein described and illustrated in order to explain the nature of the process may be made by those skilled in the art within the principle and scope of the process as expressed in the appended claims.

The invention claimed is:

1. A method for providing a system for transferring heat to process fluids, the method comprising:

providing one or more conduits having a length and an inner surface;

sizing each conduit to accommodate a process fluid flowing therethrough at a Reynolds Number of at least about 275,000, and to receive an inconsistent heat flux along the length of the conduit sufficient to increase the average bulk temperature of the process fluid by a predetermined amount;

providing one or more ridges on at least a portion of the conduit inner surface and configuring the one or more ridges to provide a temperature ratio and a pressure ratio for the conduit relative to the conduit without the one or more ridges;

the temperature ratio defined by formula A below $$\frac{[T_{(conduit\ inside\ surface)} - T_{(bulk\ process\ fluid)}]_{(conduit)}}{\left[\begin{array}{c} T_{(conduit\ without\ ridges\ inside\ surface)} - \\ T_{(equivalent\ bulk\ process\ fluid)} \end{array}\right]_{(conduit\ without\ ridges)}} \quad \text{(A)}$$

and is from about 0.6 to about 0.9 and the pressure ratio is defined by formula B $$\frac{[\Delta P/\text{Unit Length}]_{(conduit)}}{[\Delta P/\text{Unit Length}]_{(conduit\ without\ ridges)}} \quad \text{(B)}$$

and is about 1.2 to about 1.7;

wherein $T_{(conduit\ inside\ surface)}$=temperature of the conduit inside surface;

$T_{(bulk\ process\ fluid)}$=temperature of the bulk process fluid in the conduit;

$T_{(conduit\ without\ ridges\ inside\ surface)}$=temperature of the conduit without ridges inside surface having the process fluid flowing therethrough;

$T_{(equivalent\ bulk\ process\ fluid)}$=temperature of the bulk process fluid in the conduit without ridges having the process fluid flowing therethrough;

$[\Delta P/\text{Unit Length}]_{(conduit)}$=pressure drop per unit length in the conduit portion having the one or more ridges; and $[\Delta P/\text{Unit Length}]_{(conduit\ without\ ridges)}$=pressure drop per unit length in the conduit without ridges having the process fluid flowing therethrough.

2. The method of claim 1, wherein the one or more ridges are positioned along about 15 to about 50 percent of the length of each conduit, and extend through the length of the conduit subject to the maximum heat flux.

3. The method of claim 1, wherein a minimum length necessary to provide the bulk temperature is determined so that a conduit wall temperature limit is not exceeded.

4. The method of claim 1, wherein the one or more ridges are dimensioned to increase the heat transfer to the process fluid without substantially increasing the overall pressure-drop in the process fluid flow through each conduit.

5. The method of claim 4, wherein the heat flux is provided by a radiant heat source having a peak radiant heat flux up to about three times greater than an average radiant heat flux.

6. The method of claim 5, wherein each conduit has a longitudinal axis extending along the length thereof and the one or more ridges extend substantially parallel to the longitudinal axis on the inner surface of the conduit corresponding to at least the peak radiant heat flux.

7. The method of claim 3, wherein the length of each conduit is less than the length of a conduit without the one or more ridges providing the predetermined bulk temperature to the process fluid with the same heat source and the same conduit wall temperature limit.

8. The method of claim 1, wherein the method further comprises providing one or more substantially U-shaped conduits, each substantially U-shaped conduit includes a pair of generally straight leg portions and a curved portion connecting ends of the generally straight leg portions, each substantially U-shaped conduit has an overall length including a leg length of each generally straight leg portion and a curved length of the curved portion, and wherein the one or more ridges are positioned along about 35 to about 100 percent of the leg length of one of the generally straight leg portions and the other generally straight leg portion and the curved portion are free-of the one or more ridges.

9. The method of claim 8, wherein the overall length of each substantially U-shaped conduit is about 15 to about 35 percent less than a U-shaped conduit having the same conduit wall temperature limit without ridges.

10. The method of claim 9, wherein the heat transfer system has about 3 to about 8 percent fewer of the substantially U-shaped conduits than a system with U-shaped conduits having the same conduit wall temperature limit without ridges.

11. The method of claim 1, wherein the one or more conduits are formed from a material having a thermal conductivity of about 16 Btu/hr/ft/° F. or less;

the heat flux is provided by a radiant heat source providing heat flux of up to about 100,000 Btu/hr/ft$^2$, the heat flux along the conduit providing an average bulk temperature of the process fluid of at least about 537° C. (1000° F.); and the one or more ridges configured to increase the heat transfer to the gas-phase fluid such that the difference between the average bulk temperature of the gas-phase fluid and the temperature of the inside surface of each conduit subject to a maximum heat flux does not exceed about 635° C. (1175° F.).

12. The method of claim 1, wherein the one or more ridges are configured to provide an overall pressure drop of the gas-phase fluid through each conduit of about 27 kPa (4 psi) or less.

13. The method of claim 1, wherein the each conduit length is a minimum length necessary to provide the average bulk temperature of the gas-phase fluid without exceeding the conduit inside surface temperature and said minimum conduit length is less than the minimum length of the conduit without the one or more ridges required to provide the average bulk temperature of the gas-phase fluid without exceeding the conduit inside surface temperature.

14. The method of claim 13, wherein the conduit includes the ridges continuously on about 15 to about 50 percent of the length of the conduit.

15. The method of claim 1, wherein the ridges include a ridge side wall inclined relative to a radial axis of the conduit about 2 to about 6 degrees.

16. The method of claim 15, wherein the ridges include a ratio of a ridge height to a conduit radius of about 14 to about 79.

* * * * *